United States Patent [19]

Alves

[11] Patent Number: 4,648,509

[45] Date of Patent: Mar. 10, 1987

[54] TAMPER-PROOF PACKAGE AND METHOD

[76] Inventor: Dario M. Alves, 2441 California St., N.W., Washington, D.C. 20008

[21] Appl. No.: 885,093

[22] Filed: Jul. 14, 1986

[51] Int. Cl.[4] ..... B65D 73/00

[52] U.S. Cl. ..... 206/459; 206/802; 206/614; 206/807; 206/828; 229/102; 383/5

[58] Field of Search ..... 206/436, 459, 497, 499, 206/602, 610, 614, 618, 807, 828; 215/250, 251; 229/102, 87 C, 87 G; 383/5, 37, 66, 67; 220/403, 410; 53/170, 173, 174, 412, 449

[56] References Cited

U.S. PATENT DOCUMENTS

| | | | |
|---|---|---|---|
| 1,743,980 | 1/1930 | Samson | 215/251 |
| 2,006,705 | 7/1935 | Bangs | 220/403 |
| 2,131,774 | 10/1938 | Waring | 215/250 |
| 2,268,970 | 1/1942 | Tindal | 229/87 C |
| 2,524,162 | 10/1950 | Chavannes et al. | 53/449 |
| 3,043,067 | 7/1962 | Rynkiewicz et al. | 53/449 |
| 3,343,747 | 9/1967 | Molins | 206/614 |
| 3,526,315 | 9/1970 | Killian | 206/497 |
| 3,577,699 | 9/1968 | Silver | 53/449 |
| 3,620,439 | 11/1971 | Morse | 220/403 |
| 3,937,328 | 2/1976 | Gordon | 206/806 |
| 4,340,138 | 7/1982 | Bernhardt | 220/410 |
| 4,377,234 | 3/1983 | Kaplan | 206/497 |
| 4,436,203 | 3/1984 | Reyner | 206/807 |
| 4,449,632 | 5/1984 | Marusiak, Jr. | 206/807 |
| 4,465,185 | 8/1984 | Sur | 229/87 C |
| 4,484,681 | 11/1984 | Consiglio, Jr. | 206/499 |
| 4,508,226 | 4/1985 | Davis et al. | 206/807 |
| 4,537,309 | 8/1985 | Boorsma | 206/807 |
| 4,538,740 | 9/1985 | Petersen, Jr. | 215/250 |
| 4,546,881 | 10/1985 | Tasma | 206/459 |
| 4,558,794 | 12/1985 | Towns et al. | 215/250 |
| 4,589,545 | 5/1986 | Choe | 229/87 C |

FOREIGN PATENT DOCUMENTS

| | | | |
|---|---|---|---|
| 1025034 | 4/1966 | United Kingdom | 383/5 |

*Primary Examiner*—Joseph Man-Fu Moy
*Assistant Examiner*—David T. Fidei
*Attorney, Agent, or Firm*—Walter F. Wessendorf, Jr.

[57] ABSTRACT

Discloses a tamper-proof package for an article. A first container in which the article is placed has a sealed end flap whose opening indicates tampering. The first container is cellophane-wrapped with a tear strip whose tearing open of which indicates tampering. The first container is enclosed in a second container having a sealed top cover, overlying band and vertical tear strip. Tearing off the top cover, tearing apart the band and tearing open the second container via its tear strip provide three further indications of tampering. The second container is enclosed in a pouch having top and bottom sealed ends. Tearing across the sealed ends provides two further indications of tampering.

6 Claims, 6 Drawing Figures

TAMPER-PROOF PACKAGE AND METHOD

BACKGROUND OF THE INVENTION

1. Technical Field

This invention relates to a tamper-proof package to indicate to the purchaser whether or not the package has been tampered with and hence to warn the purchaser that the contents, such as medicine has been tampered with as well.

2. Background

The problem in the art to which this invention apertains is the need for a tamper-proof package that will provide multiple successive indications to the purchaser whether or not the package has been tampered with in gaining ultimate access to the contents.

SUMMARY OF THE INVENTION

Accordingly, the object of the invention is to contribute to the solution of the discussed problem of the art by providing a tamper-proof package comprising a first container that is end-flap sealed and in which the contents, such as medicine, is enclosed. The first container is sealed by a celophane wrap that can be opened along its tear strip band. The cellophane-wrapped first container is enclosed within a second container that has a heat sealed top cover, a horizontal advertising band and a vertical octopus leg tear strip. The second container is enclosed by a pouch whose ends are closed and heat and/or pressure sealed, and may be opened by tearing same across the ends. Opening the pouch provides two initial indications of tampering; opening the heat-sealed top cover of the second container, tearing the horizontal advertising band and separating the second container by tearing the vertical tear strip provide three additional indications of tampering; tearing apart the cellophane wrapper via its tear strip provides the sixth indication of tampering; and opening the closed end sealed end-flap of the first container would provide the seventh indication of tampering.

BRIEF DESCRIPTION OF THE DRAWINGS

This object and other objects of the invention should be discerned and appreciated from the drawings, wherein like reference numeral refer to similar parts throughout the several views, in which.

DESCRIPTION OF THE PREFERRED EMBODIMENT

Figure 2:
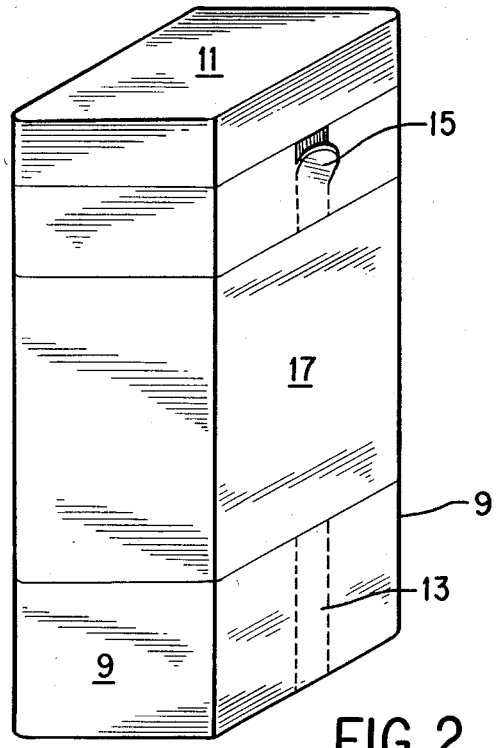
FIG. 2 is a perspective view showing the second container.
Figure 1:
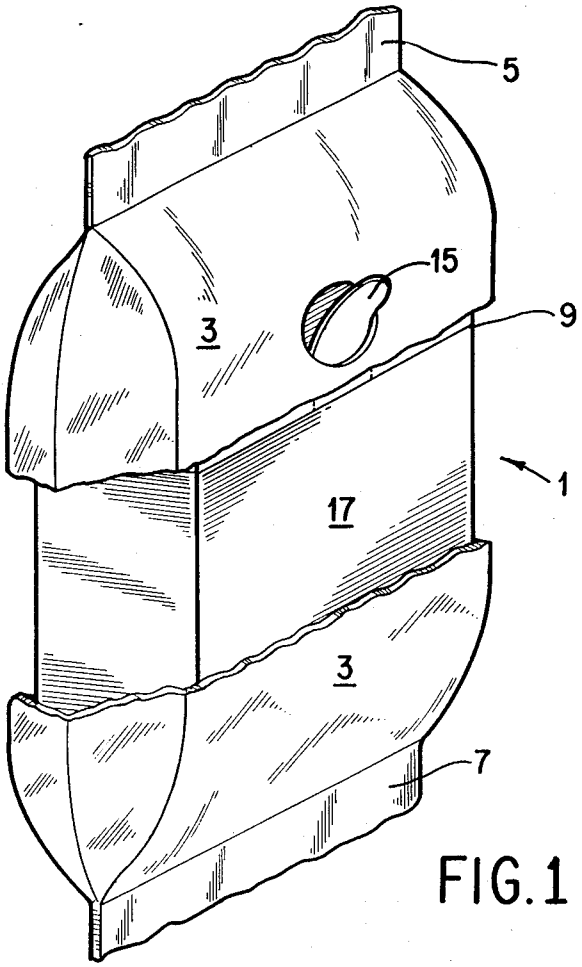
FIG. 1 is a perspective view showing the pouch enclosing a second container.

In FIG. 1 of the drawings, reference numeral 1 generally refers to the invention of the tamper-proof package comprising a pouch 3 whose top and bottom ends 5 and 7 are closed and heat and/or pressure sealed.

Figure 4:
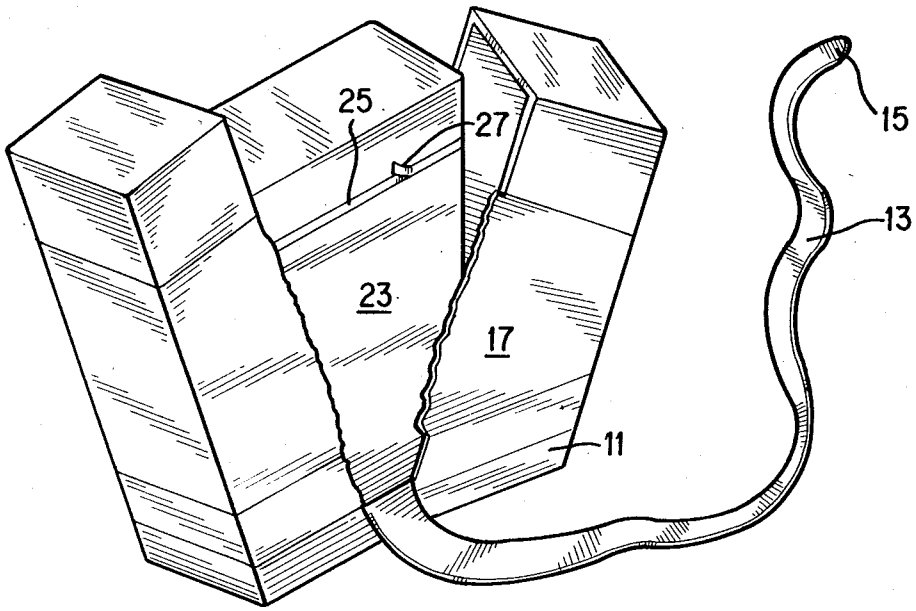
FIG. 4 is a perspective view of the second container inverted and torn apart by its vertical octopus leg tear strip.
Figure 3:
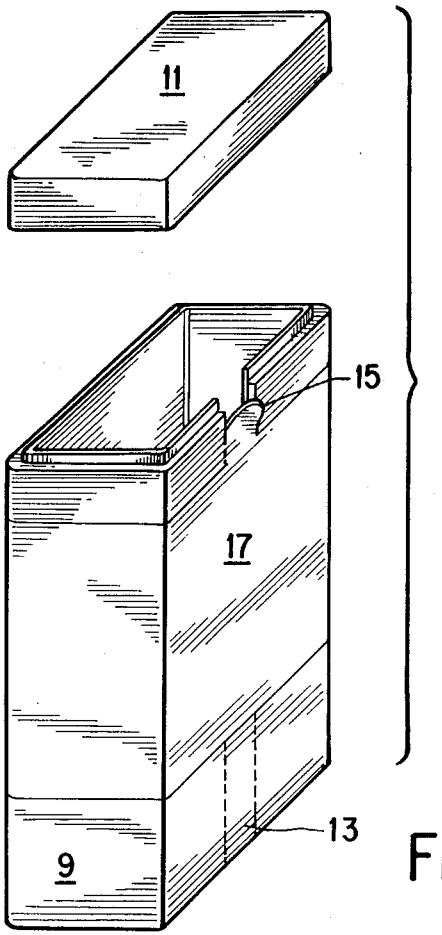
FIG. 3 is a perspective view of second container with its heat-sealed top cover removed.
Figure 6:
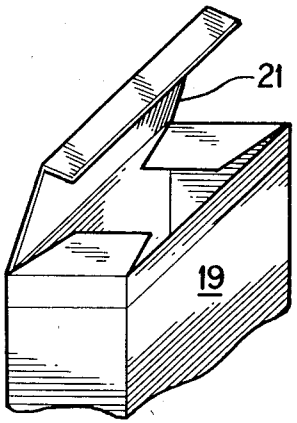
FIG. 6 is a perspective view showing the first container.
Figure 5:
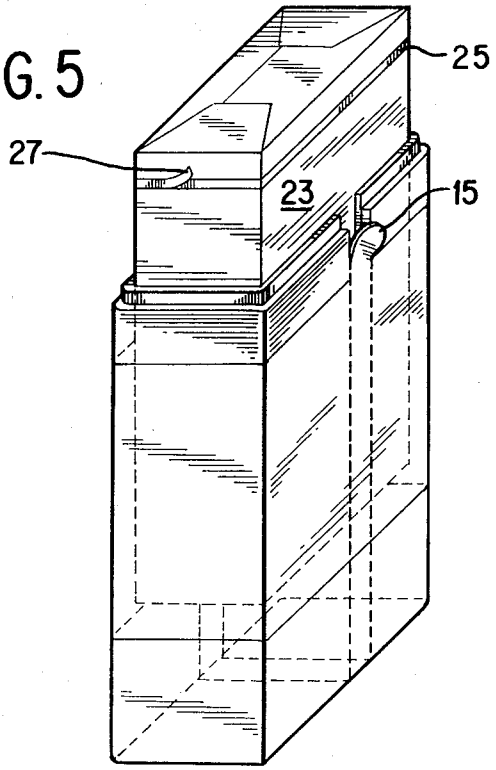
FIG. 5 is a perspective view showing the cellophane-wrapped first container partially inserted in the second container.

Pouch 3 is made of lightweight flexible material such as paper, regenerated cellulose, etc. Enclosed in pouch 3 is a second container 9 of suitable semi-rigid material such as lightweight plastic, paper and the like. Second container 9 has a heat-sealed top cover 11 which may be torn off and thereby indicate tampering. Second container 9 has a verticle octopus leg tear strip 13 which can be torn open by appropriate manipulative grasping of its tab 15. A horizontal advertising band 17 overlies tear strip 13. Grasping tab 15 and separating container 9 by means of its tear strip 13 will first tear apart the advertising band 17 to thereby indicate tampering; and then separating the second container 9, as shown in FIG. 4, to thereby indicate further tampering.

The contents, article or medicine that is to be protected against tampering is enclosed in a first container 19 that has its end flap 21 adhesively sealed. Container 19 is made of suitable material such as plastic or the like. Tearing open the end flap 21 would thereby indicate tampering. Container 19 is sealed by cellophane wrapping 23 that can be opened along its tear strip 25 by appropriate manipulative grasping of its tear tab 27. Tearing open the cellophane wrapping 23 would indicate tampering. The cellophane-wrapped first container 19 is enclosed within the second container 9.

The tamper-proof oackaging 1 provides seven separate and distinct prior indications to the purchaser that the contents, article or medicine within the first container 19 may have been subjected to tampering.

Two indications of tampering are provided when the top and bottom ends 5 and 7 of the pouch 3 are torn across. Tearing off the top cover 11 of the second container 9, tearing apart the advertising band 17 and tearing open the second container 9 via its octopus leg tear strip 13 would provide three additional indications of tampering. Tearing open the cellophane wrap 23 via its tear strip 25 would provide an additional indication of tampering. Tearing open the adhesively sealed end flap 21 of the first container 19 would be as additional indication of package tampering.

A person who intends to tamper with the contents, article or medicine contained within the first container 19 would not provide and warn a prospective purchaser of seven successive positive indications of package tampering to gain access for purposes of tampering with the packaged contents, article or medicine. Any indications that the package 1 had been tampered with would warn the prospective purchaser not to buy the package; and, if unsuspectingly bought, would warn the purchaser not to use the contents, article or medicine. Hence, the package 1 would be tamper-proof.

Having thusly described my invention, I claim:

1. A tamper-proof package for an article comprising:

a first container into which the article is placed and said first container having a self-contained independent means to indicate tampering with said first container;

a cellophane wrapping entirely enclosing and sealing said first container and said wrapping having a self-contained independent means to indicate tampering with said wrapping;

a second container entirely enclosing and sealing said cellophane wrapping and the said first container, said second container having self-contained independent means to indicate tampering with said second container, said means to indicate tampering with said second container comprises an overlying band with the tearing apart of said band indicating tampering and a tear strip with the tearing open of said tear strip separating said second container and indicating tampering;

a pouch entirely enclosing and sealing said second container;

and the tearing open of said tear strip of said second container interacting with said overlying band of said second container and with said pouch by tearing apart said overlying band and by tearing open and separating said pouch to indicate tampering with said pouch.

2. A tamper-proof package in accordance with claim 1, wherein said pouch has self-contained independent means to indicate further tampering with said pouch.

3. A tamper-proof package in accordance with claim 2, wherein said means to indicate further tampering with said pouch comprise top and bottom sealed ends with the tearing across of either one of said sealed ends indicating such further tampering with said pouch.

4. A tamper-proof package for an article comprising:

a first container into which the article is placed and said first container having an adhesively sealed end flap with the tearing open of said end flap indicating tampering;

a cellophane wrapping entirely enclosing and sealing said first container, said cellophane wrapping having a horizontal tear strip with the tearing open of said tear strip indicating tampering and said horizontal tear strip being located immediately adjacent said adhesively sealed end flap of said first container;

a second container entirely enclosing and sealing said cellophane wrapping and said first container, said second container having a sealed top cover with the tearing off of said top cover indicating tampering, said second container having a horizontally disposed overlying band with the tearing apart of said band indicating tampering, and said second container having a vertical tear strip with the tearing open of said vertical tear strip indicating tampering;

a pouch entirely enclosing and sealing said second container, and said pouch having top and bottom ends with the tearing across of either one of said ends indicating tampering.

5. A method for tamper-proofing a package containing an article comprising the steps of entirely enclosing and sealing a first container containing the article and providing said first container with self-contained independent means to indicate tampering of said first container;

entirely wrapping and sealing said first container with cellophane and providing said wrapping with self-contained independent means to indicate tampering with said wrapping;

entirely enclosing and sealing a second container containing said cellophane wrapping and said first container, entirely enclosing and sealing a pouch containing said second container and providing said pouch with self-contained independent means to indicate tampering with said pouch, providing said second container with an overlying band with the tearing apart of said overlying band indicating tampering with said second container, providing said second container with a tear strip with the tearing open of said tear strip separating said second container and indicating tampering with said second container and interacting with said overlying band of said second container and with said pouch to tear apart said overlying band of said second container to separate said second container, and to tear open and separate said pouch.

6. The method of claim 5, wherein said overlying band of said second container is horizontally disposed and wherein said tear strip of said second container is vertically oriented.

* * * * *